US009410342B2

(12) United States Patent
Napier

(10) Patent No.: US 9,410,342 B2
(45) Date of Patent: Aug. 9, 2016

(54) CLIMATE CONTROLLED PORTABLE DWELLING AND METHOD OF USE

(75) Inventor: James A. Napier, Edgefield, SC (US)

(73) Assignee: Outdoor Advantage Connection LLC, Belvedere, SC (US)

( * ) Notice: Subject to any disclaimer, the term of this patent is extended or adjusted under 35 U.S.C. 154(b) by 246 days.

(21) Appl. No.: 10/714,143

(22) Filed: Nov. 15, 2003

(65) Prior Publication Data

US 2005/0103370 A1 May 19, 2005

(51) Int. Cl.
*E04H 15/32* (2006.01)
*E04H 15/14* (2006.01)

(52) U.S. Cl.
CPC ..... *E04H 15/32* (2013.01); *E04H 15/14* (2013.01)

(58) Field of Classification Search
CPC ..... E04H 15/32; E04H 15/14
USPC ..... 52/79.1, 79.5, 79.9, 2.11, 2.22, 14, 52/2.25, 3, DIG. 13–DIG. 14; 135/93, 94, 135/124, 125
See application file for complete search history.

(56) References Cited

U.S. PATENT DOCUMENTS 1,317,271 A * 9/1919 Crosely ..... 296/145
2,288,538 A * 6/1942 Morrison ..... 454/237
2,343,581 A * 3/1944 Reeves ..... 62/217
2,658,439 A * 11/1953 Royal ..... 454/119
2,664,890 A * 1/1954 Wallace ..... 128/205.26
2,939,467 A * 6/1960 Meyer et al. ..... 52/2.13
3,059,657 A * 10/1962 Turner ..... 52/2.24
3,159,165 A * 12/1964 Cohen et al. ..... 52/1
3,261,659 A * 7/1966 Schwichtenberg et al. ..... 422/4
3,265,059 A 8/1966 Mathews
3,272,199 A * 9/1966 Matthews ..... 600/21
3,293,405 A * 12/1966 Costanzo ..... 219/211
3,335,529 A * 8/1967 Gedney ..... 52/2.14
3,353,309 A * 11/1967 Kwake ..... 52/2.14
3,452,764 A * 7/1969 Bell ..... 135/124
3,766,844 A 10/1973 Donnelly et al.
3,839,832 A * 10/1974 Kastner ..... 52/2.14
3,848,279 A 11/1974 Ipsen
4,000,749 A * 1/1977 Busco ..... 600/21
4,076,551 A * 2/1978 Bernhard et al. ..... 106/417
4,164,829 A * 8/1979 Sadler ..... 52/2.14
4,192,352 A * 3/1980 Hakamada et al. ..... 138/149
4,296,960 A 10/1981 Winchester
4,308,905 A * 1/1982 Gallagher ..... 150/165
4,332,114 A * 6/1982 Goebel et al. ..... 62/262
4,369,591 A * 1/1983 Vicino ..... 40/610
4,473,826 A * 9/1984 Pusch et al. ..... 342/5
4,625,468 A * 12/1986 Hampel ..... 52/2.24
4,784,172 A 11/1988 Yacoboni
4,974,829 A 12/1990 Gamow et al.
5,240,021 A 8/1993 Snodgrass
5,331,991 A 7/1994 Nilsson
5,706,846 A * 1/1998 Sutton ..... 135/128
5,715,854 A * 2/1998 Andrieux et al. ..... 135/94

(Continued)

FOREIGN PATENT DOCUMENTS

EP 0 345 600 A1 12/1989

*Primary Examiner* — Jeanette E Chapman
(74) *Attorney, Agent, or Firm* — Technology Legal Counsel LLC

(57) ABSTRACT

The present invention relates generally to climate control systems directed to regulating the ambient temperature within a portable dwelling, and more particularly to manufactured tents, after-market tent adapter kits and methods for utilizing these tents and adapter kits to regulate temperature preferably in the outdoors.

18 Claims, 5 Drawing Sheets

(56) References Cited

U.S. PATENT DOCUMENTS

| | | | | |
|---|---|---|---|---|
| 5,765,584 | A * | 6/1998 | Heisler et al. | 135/93 |
| 5,970,661 | A * | 10/1999 | Bishop et al. | 52/2.11 |
| 6,026,800 | A | 2/2000 | Barker | |
| 6,266,927 | B1 * | 7/2001 | Leslie | 52/2.17 |
| 6,302,094 | B1 | 10/2001 | Wehrly et al. | |
| 6,363,955 | B1 * | 4/2002 | Louie | 135/126 |
| 6,450,186 | B1 | 9/2002 | Pearcy | |
| 6,565,624 | B2 * | 5/2003 | Kutt et al. | 95/8 |
| 6,679,009 | B2 * | 1/2004 | Hotes | 52/86 |
| 6,742,309 | B2 * | 6/2004 | Stewart et al. | 52/79.5 |
| 6,796,896 | B2 * | 9/2004 | Laiti | 454/229 |
| 6,875,119 | B2 * | 4/2005 | Murphy et al. | 472/134 |
| 7,232,370 | B1 * | 6/2007 | Newell | 454/366 |
| 2002/0083653 | A1 | 7/2002 | Hilbert | |

* cited by examiner

CLIMATE CONTROLLED PORTABLE DWELLING AND METHOD OF USE

FIELD OF INVENTION

The present invention relates generally to climate control systems directed to regulating the ambient temperature within a portable dwelling, and more particularly to manufactured tents, after-market tent adapter kits and methods for utilizing these tents and adapter kits to regulate temperature preferably in the outdoors.

BACKGROUND OF THE INVENTION

Camping is a universally translatable activity that is enjoyed by friends and families the world over. Some choose to face the challenge of the outdoors as a reminder of simpler times. Others, however, go along with the rest of the family but are not as fond of leaving the creature comforts of home. No matter what reason brings the camper to the outdoors, most can recall an experience where they wish they only had some heat and/or air to make their sleeping experience a little more enjoyable.

As an alternative, many campers have chosen to purchase Recreation Vehicles (Rvs) rather than endure the extreme hot or cold condition in tents. Another alternative is found in constructible protective shelters, which may have elaborate air purification and conditioning systems. Unfortunately, both of these alternatives are prohibitively expensive for most outdoor enthusiasts. Moreover, these alternatives generally and specifically RVs are not particularly suited for use in more remote locations. Moreover, individuals with existing tents that they like would have to discard a perfectly good tent to opt for these alternatives.

Therefore, there remains an existing need for a tent that is configured to receive a standard window mountable air conditioning and/or heating unit that allows for efficient climate control within the tent without allowing rain, snow or other elemental precipitants to penetrate the tent at the point of entry for the climate control unit. There is also a need for a kit that allows the owner of an existing tent to make after-market adaptations to their tent to provide the features of the integrated tent. To this end, it would be preferable if the kit allowed for easy installation at an economically reasonable price.

SUMMARY OF EXEMPLARY EMBODIMENTS

In preferred embodiments, there is a principal objective to provide a tent suitably configured to receive a portable climate control system. In the furtherance of this and other objectives, an exemplary tent provides an aperture through which the climate control system circulates conditioned air to the interior of the tent. Moreover, the climate control system itself is at least partially covered so as to form a seal between the climate control system and the tent. This seal serves as a protective barrier and eliminates the intrusion of moisture into the tent or the climate control system itself.

Still another objective is to provide a kit that allows the above features and benefits of the climate-controlled tent to be integrated into existing tents. In the furtherance of this and other objectives, the kit comprises a tent perforation template, flange coupling system and a boot to attach the climate control system to the existing tent and provide a resealable aperture in the tent for receiving the conditioned air from the climate control system.

Yet another objective of select embodiments of the present invention is to provide a suitable backup power supply in the event that the climate control tent is being utilized in a camping setting where a 110 outlet or equivalent power source is not available. It is preferable that such power source is compact yet powerful enough to support a climate control unit of about around 5,000-15,000 BTU's.

Further objectives, features and advantages of the invention will be apparent from the following detailed description taken in conjunction with the accompanying drawings.

DETAILED DESCRIPTION OF AN EMBODIMENT

Figure 1:
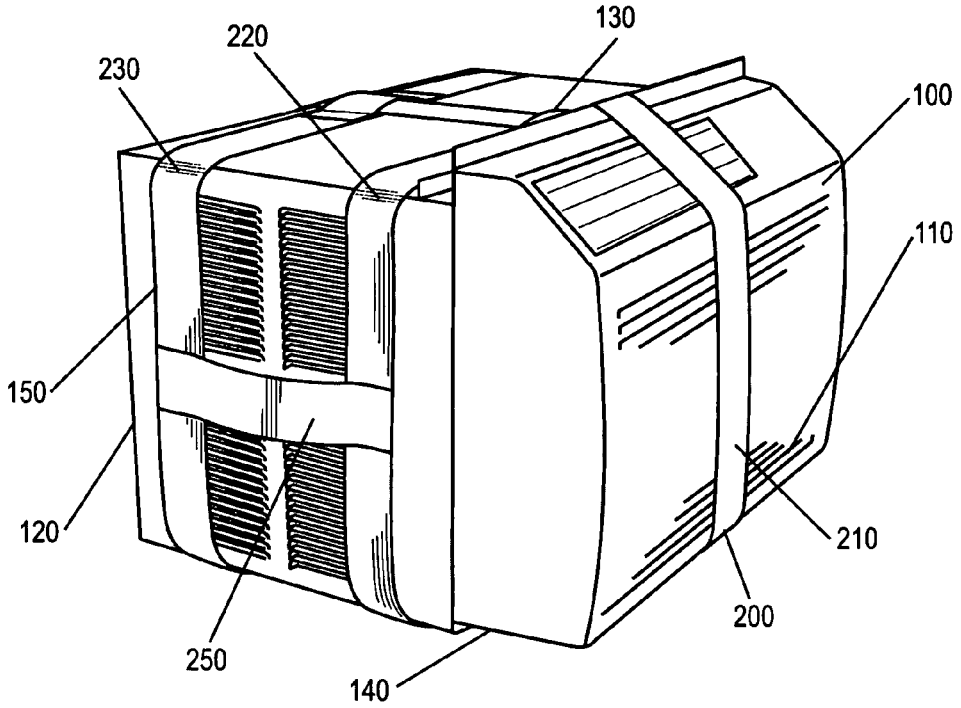
FIG. 1 is a perspective view of one side of an exemplary portable climate control unit and exemplary carrying device for use with a climate control dwelling in accordance with the present invention.

The present invention, in a preferred embodiment, provides a portable climate controlled dwelling and method of use. In particular, the present portable dwelling is designed to receive a small air conditioning and/or heating unit in a reversible manner. To this end, the dwelling can be used with or without the climate control system without there being a hole in the side of the dwelling through which the external elements can enter. In preferred embodiments, the present dwelling can be used with any conventional air conditioning or heating unit, however, a combined heat and cooling unit such as the Model CAH12WRL manufactured by Crosley®, is preferred. It should be kept in mind that though the combined unit is preferred, the present inventor has discovered that the approximate 11,000 BTU output of the Crosley® unit is not required. The optimal output for most standard tents is in the range of about between 5,000-6,000 BTU's.

In the pre-manufactured portable climate control dwellings, the aperture is resealable through conventional means including but not limited to adhesives, snaps, zippers and Velcro®, provided the seal is water resistant. Also, in alternative embodiments, the boot that partially covers the climate control unit may be removable provided that when it is reattached is sufficiently prevents the climate control unit and the interior of the tent from being exposed to moisture.

In the embodiments that provide a kit for after-market modification of existing tents, the kit includes a template that allows the user to create a resealable window in the tent through which the conditioned air travels from the climate control system into the living space of the tent. The tent and climate control system are coupled together with a flange that can be adhered to the tent using conventional means know in the art, including but not limited to adhesives, snaps, zippers and Velcro®, provided that the seal is water resistant.

Premanufactured portable dwellings, such as tents, can be assembled/disassembled in a variety of ways, however, the following is a general description of how to assemble one and the typical components needed therefore. Take the unassembled dwelling out of the package. The dwelling will likely consist of support members such as poles, cables or the like and a large, tarp-like sheet of cloth or plastic that comprises the portable dwelling itself. Look at the instructions and ensure that you have all necessary parts. Put the support members together to make the frame that supports and determines the shape of the dwelling's inhabitable configuration. Portable dwellings come in a variety of shapes, the most common being domes, cones, pyramids, or house shapes, however, they generally take the shape of the support structure consisting of the collection of support members. It is important that the frame is built correctly; otherwise, the cover will fit awkwardly, if it even fits at all. Once the frame is put together, put the cover on it. If you assembled the frame correctly, the cover should go right on with little struggling. Generally, in the absence of the support member(s), the portable dwelling would be uninhabitable.

Figure 2:
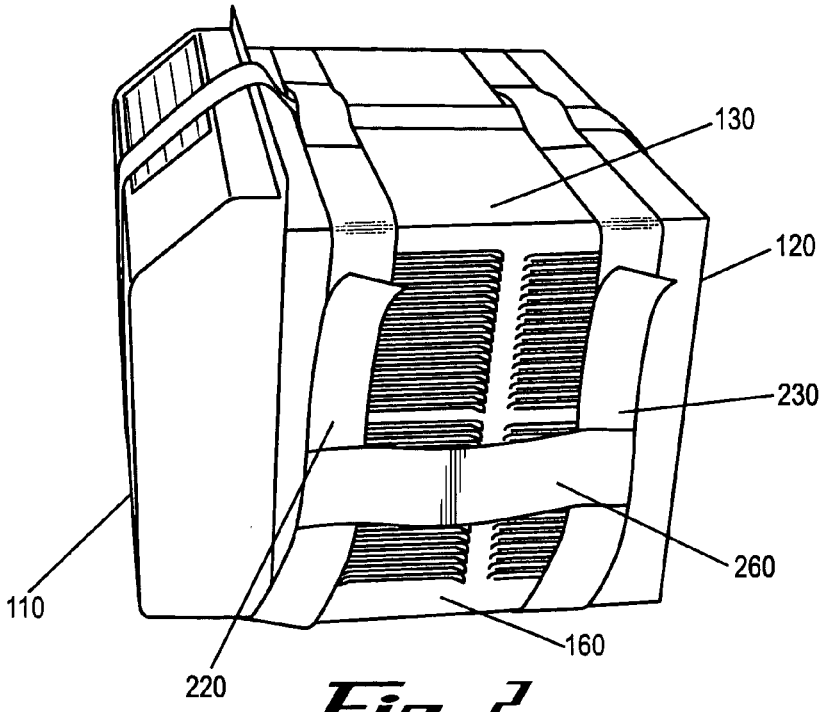
FIG. 2 is a perspective view of the opposite side of the portable climate control unit and carrying device shown in FIG. 1.
Figure 3:
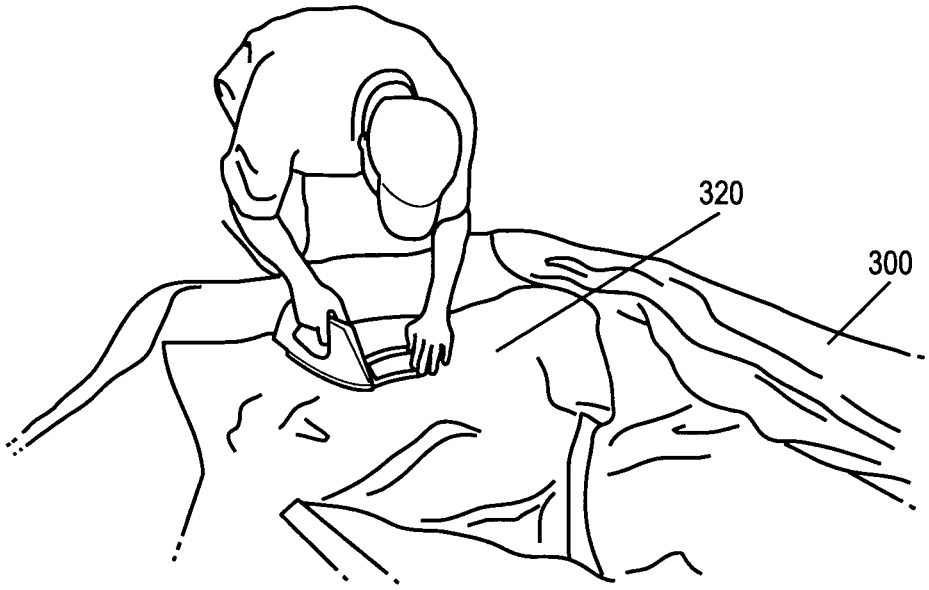
FIG. 3 is a pictorial representation of a user affixing a miniature flange to a portable climate control dwelling in accordance with specific embodiments of the present invention, in order to test the adhesive and find the center point for affixing the adapter. This view is principally of a portion of a standard tent showing the introduction of the kit for after-market modification of the dwelling.
Figure 4:
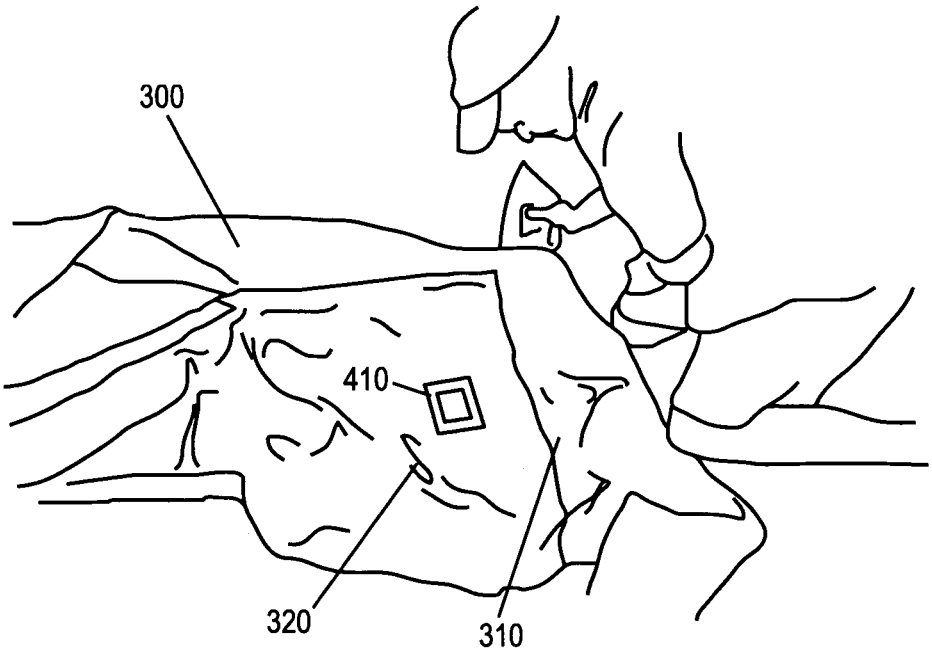
FIG. 4 is an alternative pictorial view of an exemplary portable climate control dwelling, in accordance with the present invention, showing a flange attached to the dwelling to facilitate coupling of the dwelling with the climate control unit.

Making specific reference to the figures where like numbers refer to like parts. Specifically, FIGS. 1-2 show an exemplary portable climate control unit 100 such as an air conditioner and/or heating device. In one aspect of the invention, the climate control unit 100 comprises a front 110, back 120, top 130, bottom 140, left 150, and right 160 sides as is customary with conventional units. The units 100 may vary in dimensions based on the size of the dwelling to be heated or cooled.

In order to facilitate transport and placement of the climate control unit 100, the present inventor provides a carrier 200 that can be adjusted to fit a variety of sizes of units 100. The carrier 200 preferably comprises at least one strap 210 that raps around the unit 100 from front to back or from back to front, whichever the case may be. Additionally, at least one strap 220 is provided that runs substantially perpendicular to the at least one strap 210. When additional straps 230 are provided, enhanced support and portability is provided. Additionally, straps 250 and 260 connect straps 220 and 230 on the left 150 and right 160 sides of the unit 100, respectively. The climate control unit carrier may alternatively comprise a strap webbing much like a net to provide peristaltic motion to make carrying easier. Each strap is preferably made from a durable material such as ballistic nylon, canvas, polyester, or microfiber but may be a variety of other materials known in the art.

Figure 7:
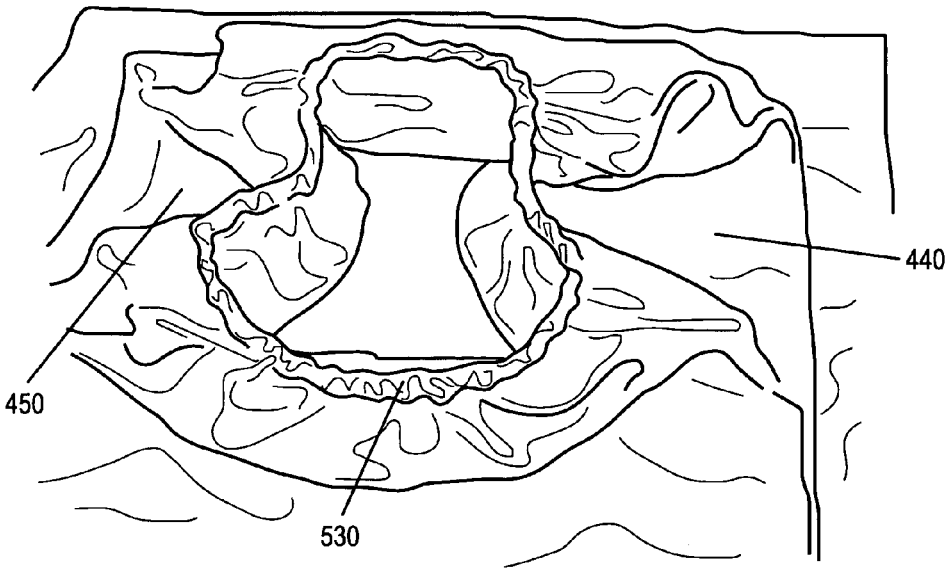
FIG. 7 is a perspective view of the boot of FIG. 6 in which the boot is stretched an ready for receiving the portable climate control unit.
Figure 8:
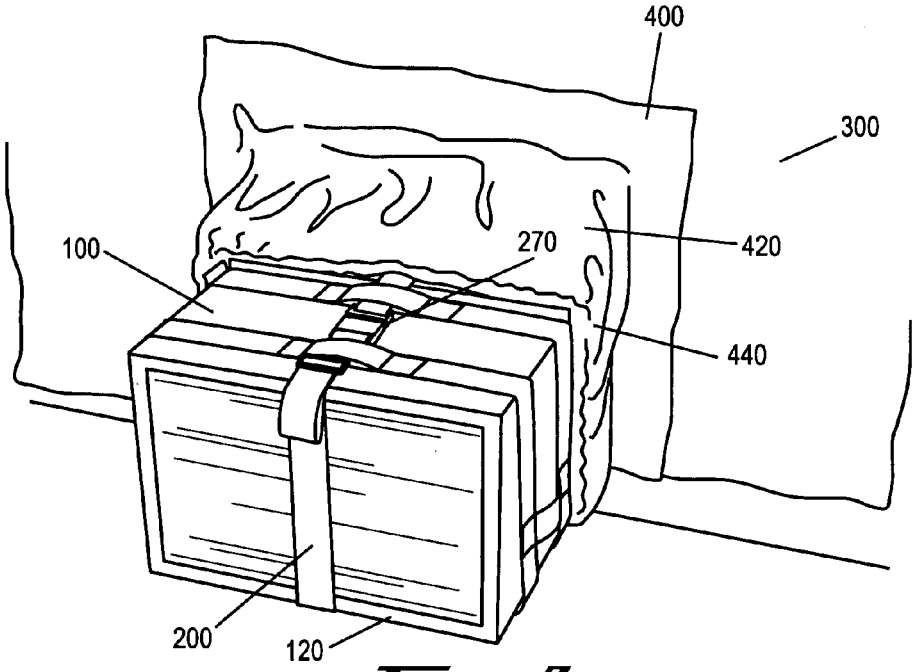
FIG. 8 is a perspective view of the exterior of a climate control dwelling showing the boot engaged about the climate control unit in a operational configuration, where the rear of the climate control unit is shown.

As discussed above, the present invention provides a climate control dwelling 300 that can be purchased in a complete kit, which comprises the dwelling 300 with a preinstalled boot 440 for receiving the climate control unit 100. In such kits, the kit may also include the climate control unit as well as the carrier 200 and an optional stand (not shown) to elevate the climate control unit 100 to the desired height in the wall of the dwelling 300. As shown specifically in FIGS. 5-9, the dwelling 300 has an aperture formed on one wall thereof for receiving the climate control unit 100. Referring specifically to FIG. 8, the dwelling 300 has a flange 400 coupled thereto for reinforcing the connection of the boot 440 to the dwelling 300. One end of the boot 440 is connected directly to the dwelling 300 or in alternative embodiments, to the dwelling 300 via the flange 400. The flange 400 is most appropriately utilized in aftermarket use of with existing tents without a preinstalled boot 440. The front 110 of the climate control unit 100 is installed through the open diameter of the boot 440, which has a form fitting edge 530. The edge 530 is form fitting because of an elastic member therein (See FIG. 7). The elastic member is preferably an elastomeric polymer such as a rubber band. The principal objective is to have a pliant edge. Alternatives may include threading a string trough the edge 530 to create a drawstring closure that can be tightened securely about the climate control unit. The boot 440 forms about the sides of the climate control unit 100 to form a weather resistant barrier between the exterior and the interior of the dwelling 300. The boot 440 alone or various combinations of the boot 440, flange 400, form fitting edge 530 and elastic member may collectively be referred to as the restraining member.

Figure 5:
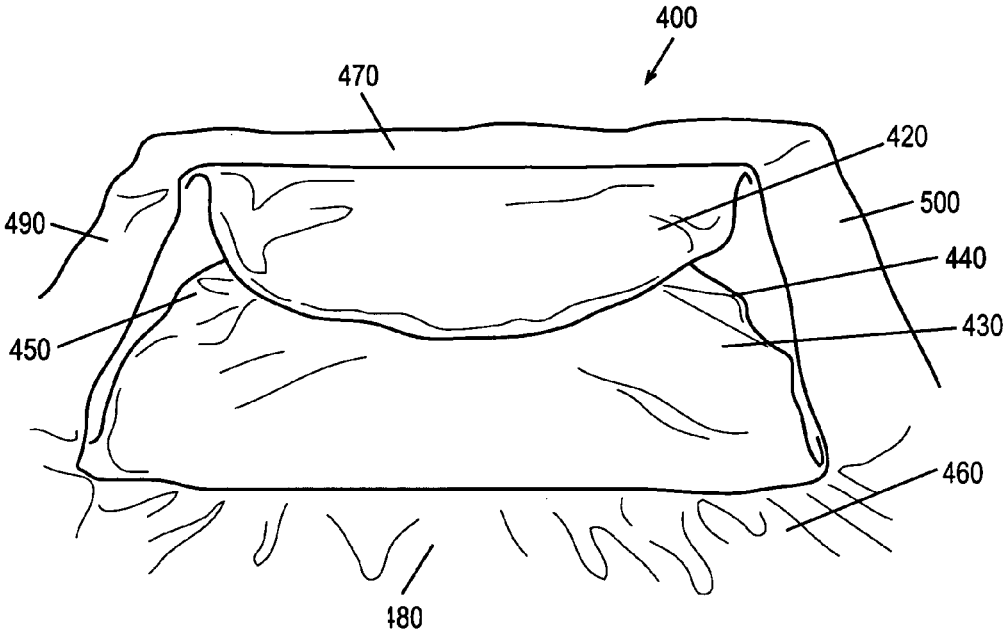
FIG. 5 is a perspective view of a climate control unit receiving boot, showing the boot engaged with the dwelling in a closed non-operational configuration.
Figure 6:
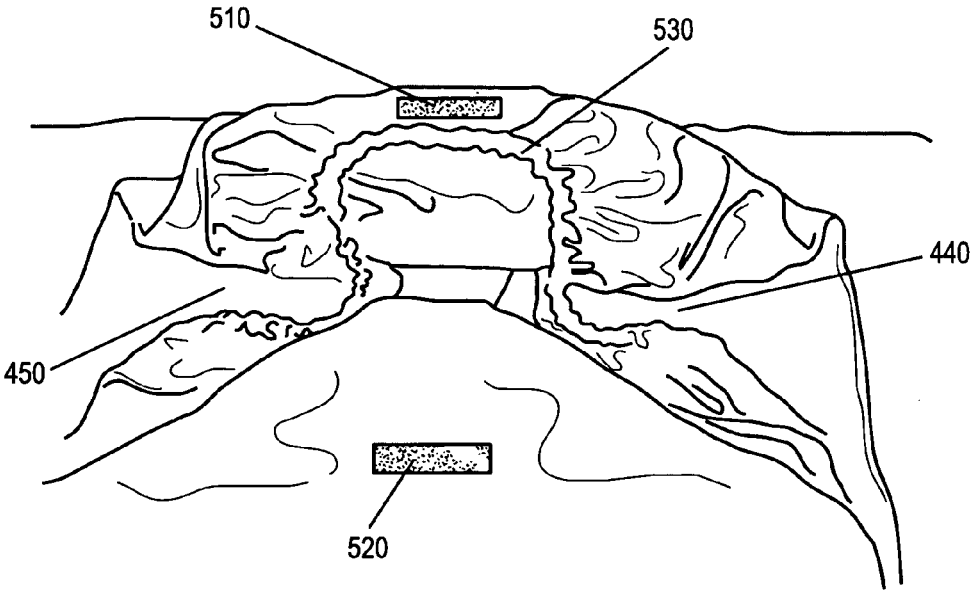
FIG. 6 is a perspective view of the boot in a partially operational configuration showing the closure members that facilitate closure and stowing of the boot in particular and the dwelling generally.
Figure 9:
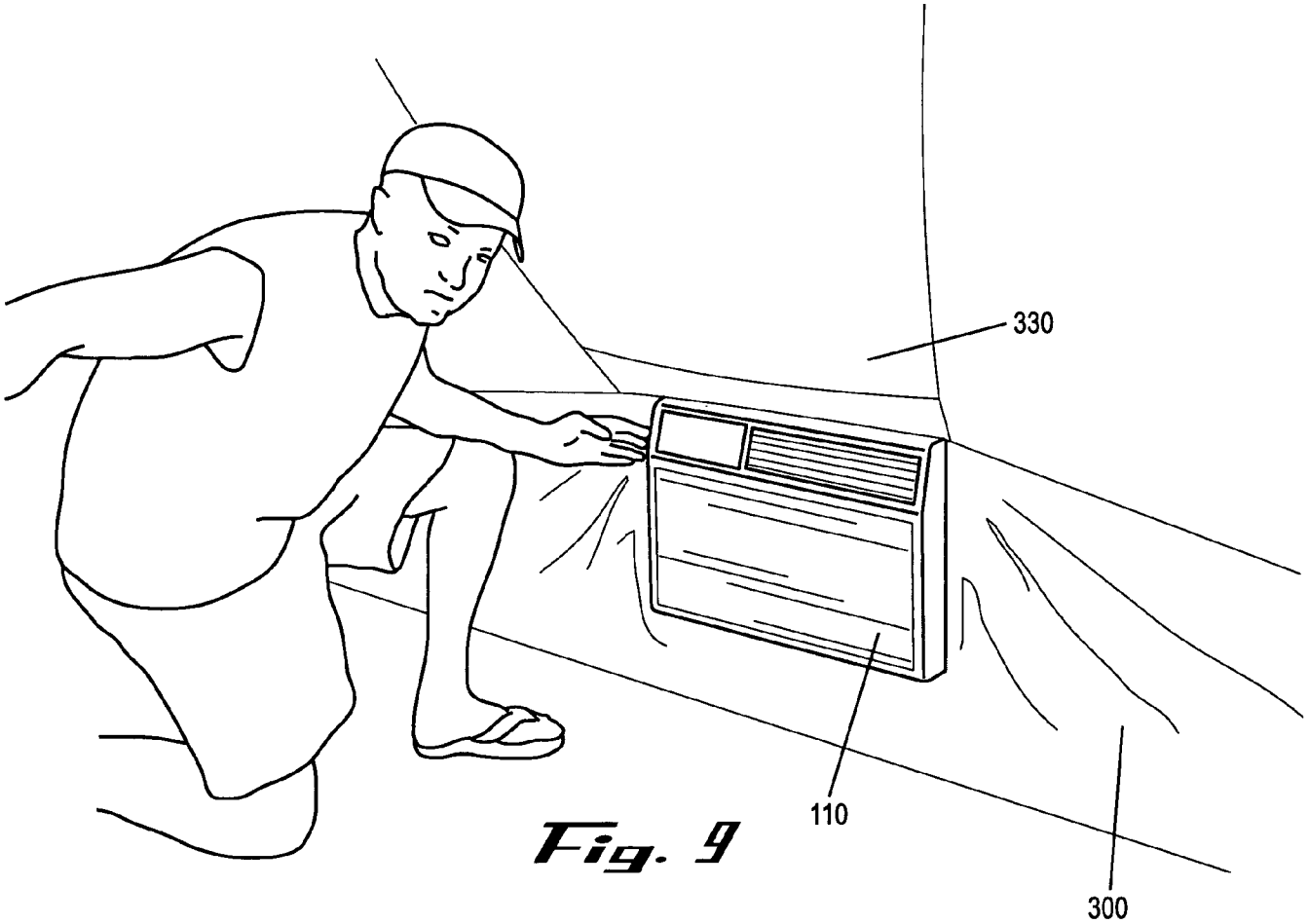
FIG. 9 is a perspective view of the interior of the climate control dwelling of FIG. 8, wherein the front of the climate control unit is shown.

FIG. 9 shows the interior 330 of dwelling 300 with the front 110 of the climate control unit 100 in the operative configuration within the dwelling 300. It should be note that the climate control dwelling remains in the inhabitable configuration even when the climate control unit 100 is not in use. When the climate control unit 100 is not in use or is not desirable, users would not want a hole in the dwelling 300 that would allow the elements to enter. The present inventor anticipated such an issue and provides a boot 440 that is easy to fold. As shown in FIGS. 5-7, the boot 440, in the closed configuration folds upon itself and with mating closures 510 and 520, which are preferably Velcro®, snaps, locks or other coupling means.

For those users that have tents have a desire to use a climate control unit 100 with their existing tent, an after market adaptation system is provided that allows for the modification of an existing tent to receive a variety of sizes of climate control units 100. As shown in FIGS. 3-7, the dwelling or tent 300 is spread out with the exterior 320 showing. It is preferable that the side of the dwelling 300 that will receive the climate control unit 100 is facing upward. A small flange 410 may be ironed on to the side of the tent to identify the location of the boot and/or test the effectiveness of the adhesive. This will also serve as the location where an aperture is formed for the climate control unit 100. The user can measure the exact height from the ground that (s)he wants to place the climate control unit. It should be kept in mind that the testing step is not required as the manufactured climate control dwellings as well as the after-market adapter kits are quality tested before sale.

Once the appropriate location is identified, the climate control adapter 400 is coupled with the exterior 320 of the dwelling 300. The adapter preferably comprises a flange 460 having four edges 470, 480, 490 and 500. Affixed to the flange 460 is boot 440, which has a top flap 420 and a bottom flap 430. The boot 440 tapers from the flange 400 to the elastic edge 530 to form a tube 450 for receiving the climate control unit 100. When the boot 420 is in use, aperture defined by the tube is open, however, when the boot 420 is not in use, it may be closed by mating closures 510 and 520 after or in lieu of folding the adapter 400.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes, which come within the meaning and range of equivalency of the claims, are to be embraced within their scope.

What is claimed is:

1. A tent defining an enclosure, a support member capable of supporting the enclosure in an inhabitable configuration, the tent interchangeably transformable between a storage configuration and the inhabitable configuration, the improvement comprising;

a boot having first and second ends defining a longitudinally extending aperture there between, the boot affixable at the first end perpendicularly to a flange for affixing a climate control unit to the tent; and a climate control unit reversibly disposed at least partially within the boot for use in the second inhabitable configuration of the tent;

the tent formed from a material that does not allow the free passage of air through multiple layers of the fabric thereof;

whereby a user of the tent has direct access to the climate control unit, which conditions the air within the enclosure of the tent, such that retention of the predetermined shape of the second inhabitable configuration is independent of the climate control unit.

2. The tent of claim 1, wherein the air is cooled.

3. The tent of claim 1, wherein the air is heated.

4. The tent of claim 1, wherein the tent defining the climate control unit-receiving aperture comprises an elastic member for engaging the climate control unit to form a weather resistant barrier between the exterior and interior of the dwelling.

5. The tent of claim 4, wherein the dwelling is ballistic nylon.

6. A portable climate control unit carrier comprising a plurality of straps, configurable about the exterior of a climate control unit.

7. The portable climate control unit carrier of claim 6, wherein the carrier is ballistic nylon.

8. A tent adapter, comprising:

a flange having a front and a back, at least a portion of the back permanently affixable to a tent;

a boot having first and second ends defining a longitudinally extending aperture there between, the boot affixable at the first end perpendicularly to the flange for affixing a climate control unit to a tent;

whereby a user of the tent adapter has direct access to the climate control unit, which conditions the air within the enclosure of the tent, such that retention of the predetermined shape of the second inhabitable configuration is independent of the climate control unit.

9. The adapter of claim 8, wherein the second end of the boot has an elastic edge.

10. The adapter of claim 8, wherein the second end has a closure for closing the aperture at the second end.

11. The adaptor of claim 8, wherein the adapter formed from a material selected from the group consisting of polymer, vinyl, nylon, cotton, leather, or combinations thereof.

12. The adapter claim 11, wherein the adapter is a ballistic nylon.

13. A kit comprising a collapsible structure defining a moisture impermeable enclosure, the collapsible structure interchangeably transformable between a first storage configuration and a second inhabitable configuration and further having a portion defining a pliant, resealable climate control unit-receiving aperture, wherein said second inhabitable configuration may be established and/or retained at the predetermined shape in the absence or presence of a climate control unit.

14. The kit of claim 13, further comprising a climate control unit.

15. The kit of claim 13, further comprising a climate control unit carrier.

16. The kit of claim 15, wherein the climate unit is an air conditioner.

17. The kit of claim 15, wherein the climate control unit is a heater.

18. The kit of claim 13 comprising an adjustable stand for holding a climate control unit at a predetermined distance in relation to the dwelling.

* * * * *